US010450097B2

(12) United States Patent
Rivola et al.

(10) Patent No.: US 10,450,097 B2
(45) Date of Patent: Oct. 22, 2019

(54) DEVICE AND METHOD FOR FEEDING AND DOSING FILTER BAGS WITH INFUSION OR EXTRACTION PRODUCTS

(71) Applicant: I.M.A. INDUSTRIA MACCHINE AUTOMATICHE S.p.A., Ozzano Dell'emilia (Bologna) (IT)

(72) Inventors: Sauro Rivola, Riolo Terme (IT); Claudio Betti, Imola (IT)

(73) Assignee: I.M.A. INDUSTRIA MACCHINE AUTOMATICHE S.p.A., Ozzano Dell'Emilia (Bologna) (IT)

( * ) Notice: Subject to any disclaimer, the term of this patent is extended or adjusted under 35 U.S.C. 154(b) by 360 days.

(21) Appl. No.: 15/510,739

(22) PCT Filed: Oct. 5, 2015

(86) PCT No.: PCT/IB2015/057614
§ 371 (c)(1),
(2) Date: Mar. 13, 2017

(87) PCT Pub. No.: WO2016/059510
PCT Pub. Date: Apr. 21, 2016

(65) Prior Publication Data

US 2017/0275031 A1 Sep. 28, 2017

(30) Foreign Application Priority Data

Oct. 15, 2014 (IT) ..... BO2014A0559

(51) Int. Cl.
*B65B 29/02* (2006.01)
*B65B 37/02* (2006.01)
(Continued)

(52) U.S. Cl.
CPC ..... *B65B 29/02* (2013.01); *B65B 1/02* (2013.01); *B65B 1/36* (2013.01); *B65B 7/02* (2013.01);
(Continued)

(58) Field of Classification Search
CPC ..... B65B 29/02; B65B 29/028; B65B 1/36; B65B 37/02
(Continued)

(56) References Cited

U.S. PATENT DOCUMENTS 2,160,367 A * 5/1939 Maxfield ..... B65B 9/213 206/524.8
2,341,340 A * 2/1944 Sternfield ..... B65B 55/24 222/145.2
(Continued)

FOREIGN PATENT DOCUMENTS

CN 1842468 A 10/2006
CN 103402886 A 11/2013
(Continued)

OTHER PUBLICATIONS

International Search Report and Written Opinion for corresponding Patent Application No. PCT/IB2015/057614 dated Oct. 5, 2015.
(Continued)

*Primary Examiner* — Gloria R Weeks
(74) *Attorney, Agent, or Firm* — Renner, Otto, Boisselle & Sklar, LLP

(57) ABSTRACT

Described is a device for feeding and dosing infusion or extraction product of a machine (100) for making filter bags (S) containing the infusion or extraction product comprising a space (2) for containing infusion or extraction product defined by an outer lateral wall (3) and by an inner lateral wall (4) comprising openings (7) for the passage of the product; a feeding chamber (6) made inside the inner lateral
(Continued)

wall (4), communicating through the openings (7) with the containment space (2) and equipped with an outlet (8) leading outside the containment space (2); a shutter (9), which is movable inside the feeding chamber (6) at least between a closed lower end position (P1), wherein it occludes the openings (7), and an open upper end position (P2), wherein it allows the passage of the product from the containment space (2) to the feeding chamber (6) through the openings (7) towards the outlet (8) to fill the filter bags (S) being formed.

19 Claims, 5 Drawing Sheets

(51) Int. Cl.

| | |
|---|---|
| ***B65B 37/08*** | (2006.01) |
| ***B65B 1/36*** | (2006.01) |
| ***B65B 1/02*** | (2006.01) |
| ***B65B 7/02*** | (2006.01) |
| ***B65D 85/808*** | (2006.01) |

(52) U.S. Cl.
CPC ..... *B65B 29/028* (2017.08); *B65B 37/02* (2013.01); *B65B 37/08* (2013.01); *B65D 85/808* (2013.01)

(58) Field of Classification Search
USPC ..... 53/451, 467, 574, 575
See application file for complete search history.

(56) References Cited

U.S. PATENT DOCUMENTS 3,090,175 A * 5/1963 Eskil ..... B31D 5/0073 156/251
3,777,447 A * 12/1973 Herbine ..... A61K 6/0061 53/239
3,831,821 A * 8/1974 Doyen ..... B65B 3/32 137/540
3,879,917 A * 4/1975 Bassendale ..... B65B 9/213 222/108
4,587,795 A * 5/1986 Yamashita ..... B65B 9/2042 222/504
4,604,854 A * 8/1986 Andreas ..... B65B 9/2028 141/392
4,606,174 A * 8/1986 Berg ..... B65B 3/04 53/451
4,608,810 A * 9/1986 Bordini ..... B65B 9/093 53/551
4,769,974 A * 9/1988 Davis ..... B65B 9/023 53/433
4,784,697 A * 11/1988 Bordini ..... B65B 55/02 134/22.15
4,838,325 A * 6/1989 Bordini ..... B65B 9/2049 134/166 R
5,548,947 A * 8/1996 Fincham ..... B26D 1/245 53/551
6,041,980 A 3/2000 Goodwin et al.
6,098,380 A * 8/2000 Goodwin ..... B65B 9/2021 53/451
6,505,664 B1 * 1/2003 Blundell ..... B26D 7/2628 156/251
7,546,721 B2 * 6/2009 Rasile ..... B65B 9/20 493/189
10,071,372 B2 * 9/2018 Nitsch ..... G01F 11/10
2008/0196359 A1 * 8/2008 Conti ..... B65B 29/025 53/113
2013/0330027 A1 12/2013 Axe et al.
2016/0207645 A1 7/2016 Meyer et al.

FOREIGN PATENT DOCUMENTS

DE 20 2013 008523 U1 10/2013
EP 0 222 695 A1 5/1987
EP 222695 A1 5/1987
EP 1 582 467 A1 10/2005
EP 1 786 676 B1 5/2008
EP 2 830 954 B1 3/2016
IT 1410589 B 9/2014
JP H08-512268 A 12/1996
JP H10-147318 A 6/1998
JP 2002-059902 A 2/2002
JP 2005-289517 A 10/2005
JP 2009-286451 A 12/2009
KR 101422402 B1 7/2014
WO 95/01907 A2 1/1995
WO 2010/07691 A1 1/2010
WO 2010/055591 A1 5/2010

OTHER PUBLICATIONS

Office Action for corresponding Chinese Application No. 201580055880.5 dated Sep. 27, 2018.
Notice of Reasons for Refusal for corresponding Japanese Patent Application No. 2017-520349 dated May 22, 2019.

* cited by examiner 14
13a
102
13b
100
1
103
V1
D1, D2, D3
104
101
ST
105
S 14
18
13a
15
X4
13b
1
19
11, 10
4, 4a
3a
3

1
18
13a
14
13b
11, 10
X1
9
12
3
4a
4
3a
7
5
7
P1
6
17
8
D1

DEVICE AND METHOD FOR FEEDING AND DOSING FILTER BAGS WITH INFUSION OR EXTRACTION PRODUCTS

This application is a national phase of International Application No. PCT/IB2015/057614 filed Oct. 5, 2015 and published in the English language, which claims priority to Italian Patent Application No. BO2014A000559 filed Oct. 15, 2014, which are hereby incorporated herein by reference in their entirety.

TECHNICAL FIELD

This invention relates to device and a method for feeding and dosing a machine for the production of filter bags with infusion or extraction products, such as tea, camomile, herbal teas, coffee, etc.

BACKGROUND ART

The prior art machines for making filter bags, in particular with infusion products, are designed according to various architectures depending on the shape of the filter bag and/or the type of product it contains.

With particular reference to vertical axis machines, such machines comprise a feed channel extending vertically on which a continuous strip of filter paper is wrapped to form a tube, into which the product is made to fall by gravity using suitable feeding and dosing devices.

Once filled with product, the tube is intercepted, during tube feed, by a forming and closing station for forming the filter bag into the desired shape and for closing the open edges.

A problem particularly felt in this type of machine is that of guaranteeing the filling of each filter bag with the a predetermined dose of product and at the same time reducing the variability in weight of the product introduced in different filter bags.

DISCLOSURE OF THE INVENTION

The aim of the invention is therefore to satisfy the above-mentioned need, that is to say, to provide a feeding and dosing device and method for a machine for the production of filter bags with infusion or extraction product which are particularly simple and with a high productivity.

Another aim of the invention is to provide a feeding and dosing device and method for a machine for the production of filter bags with infusion or extraction product which allows the introduction of a predetermined dose of product inside the filter bag and the reduction of the variability of the quantity of product introduced in the various filter bags to be garanteed.

BRIEF DESCRIPTION OF DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

Figure 1:
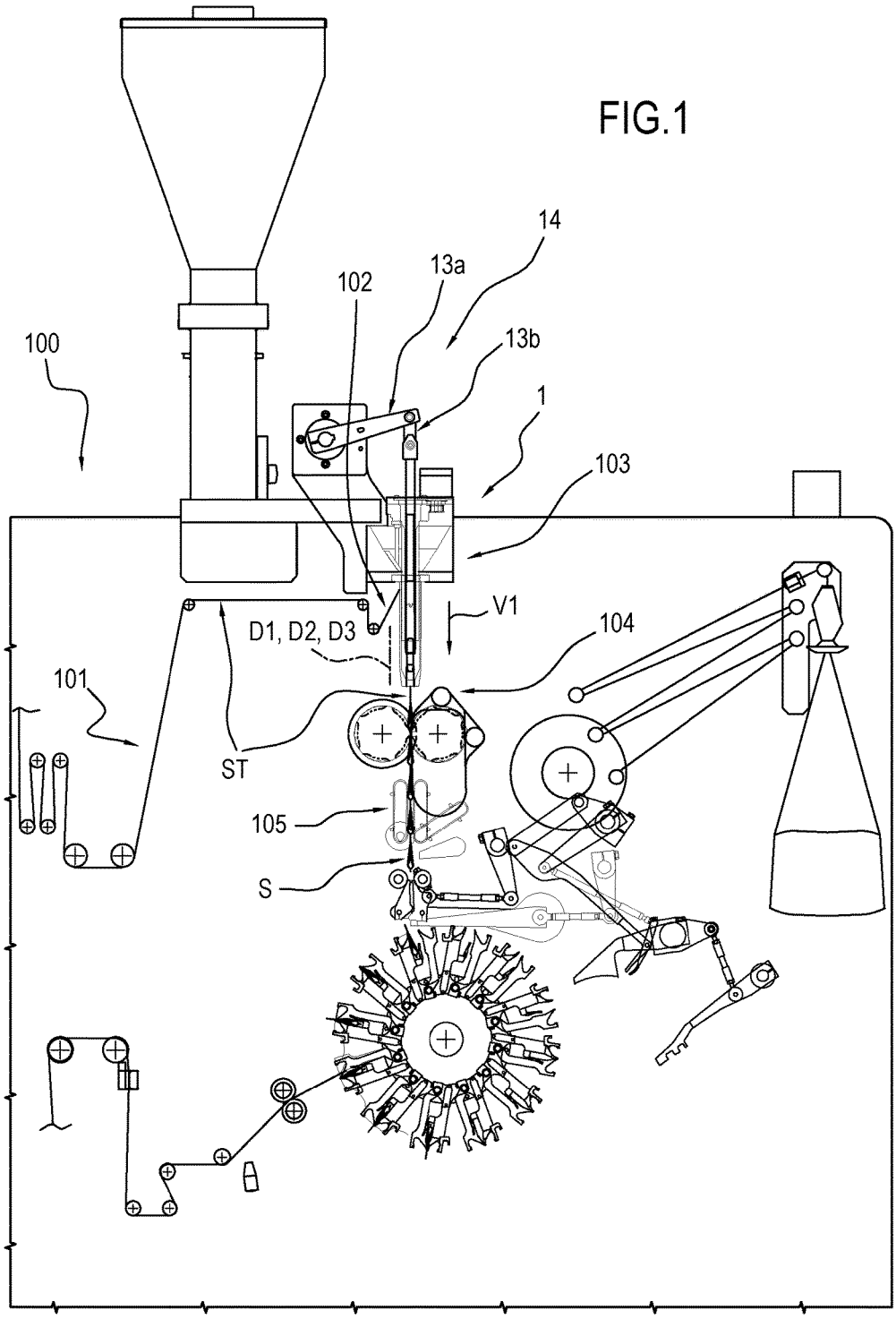
FIG. 1 is a schematic side view of a machine for the production of filter bags with infusion or extraction products comprising a feeding and dosing device according to this invention.
Figure 2:
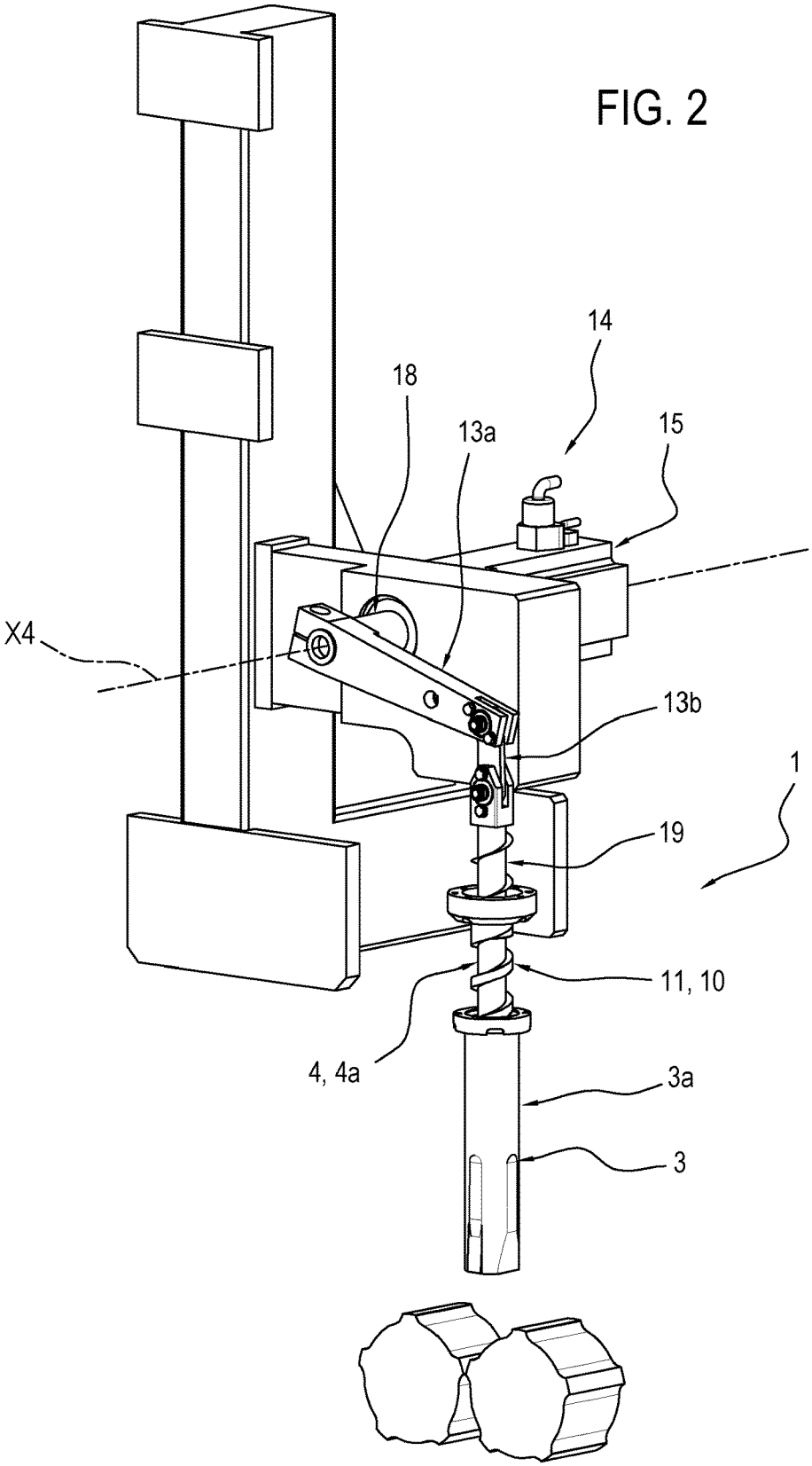
FIG. 2 is a perspective view of the feeding and dosing device according to the invention.
Figure 3:
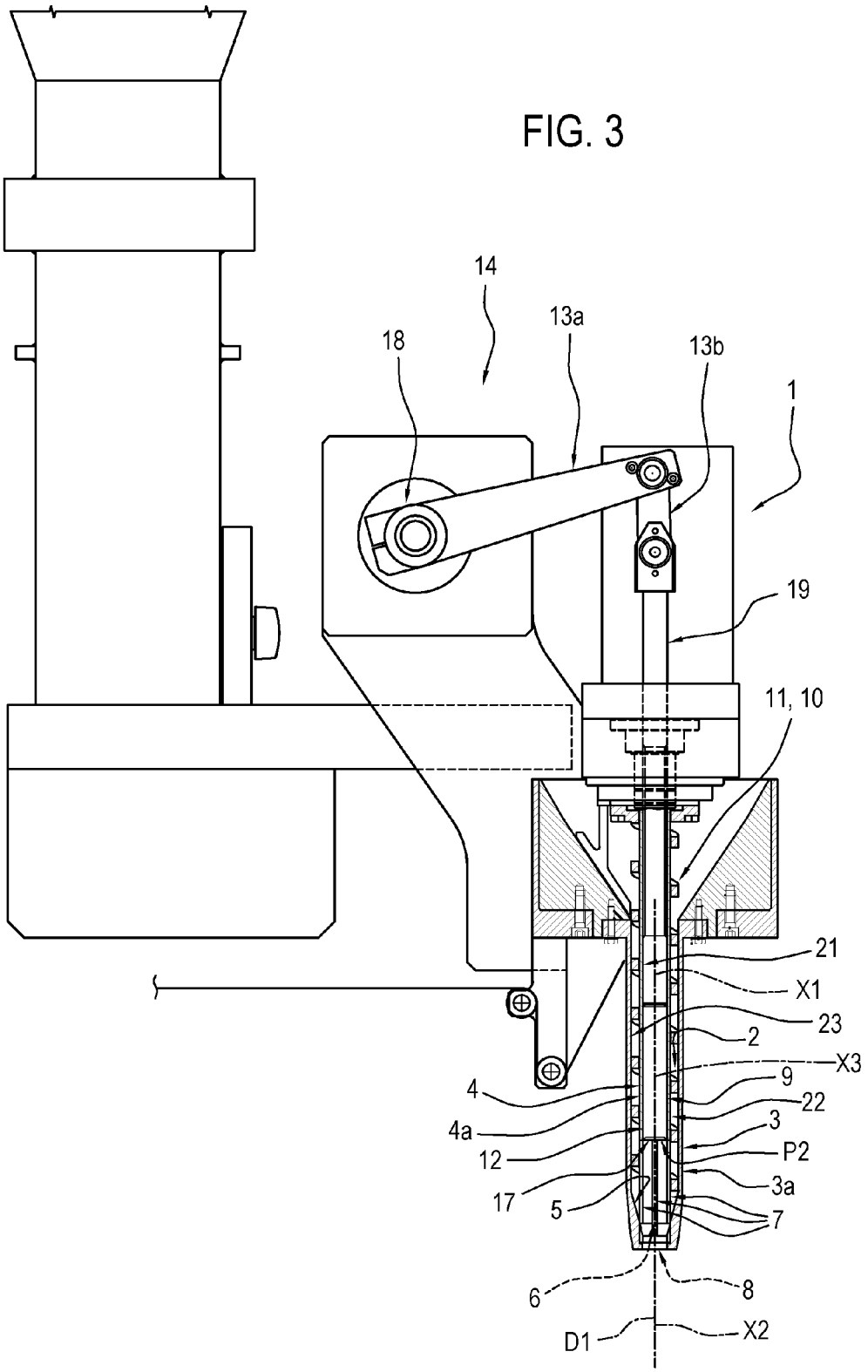
FIGS. 3 and 4 are cross section views of the feeding and dosing device of FIG. 2 in two different configurations, respectively.
Figure 4:
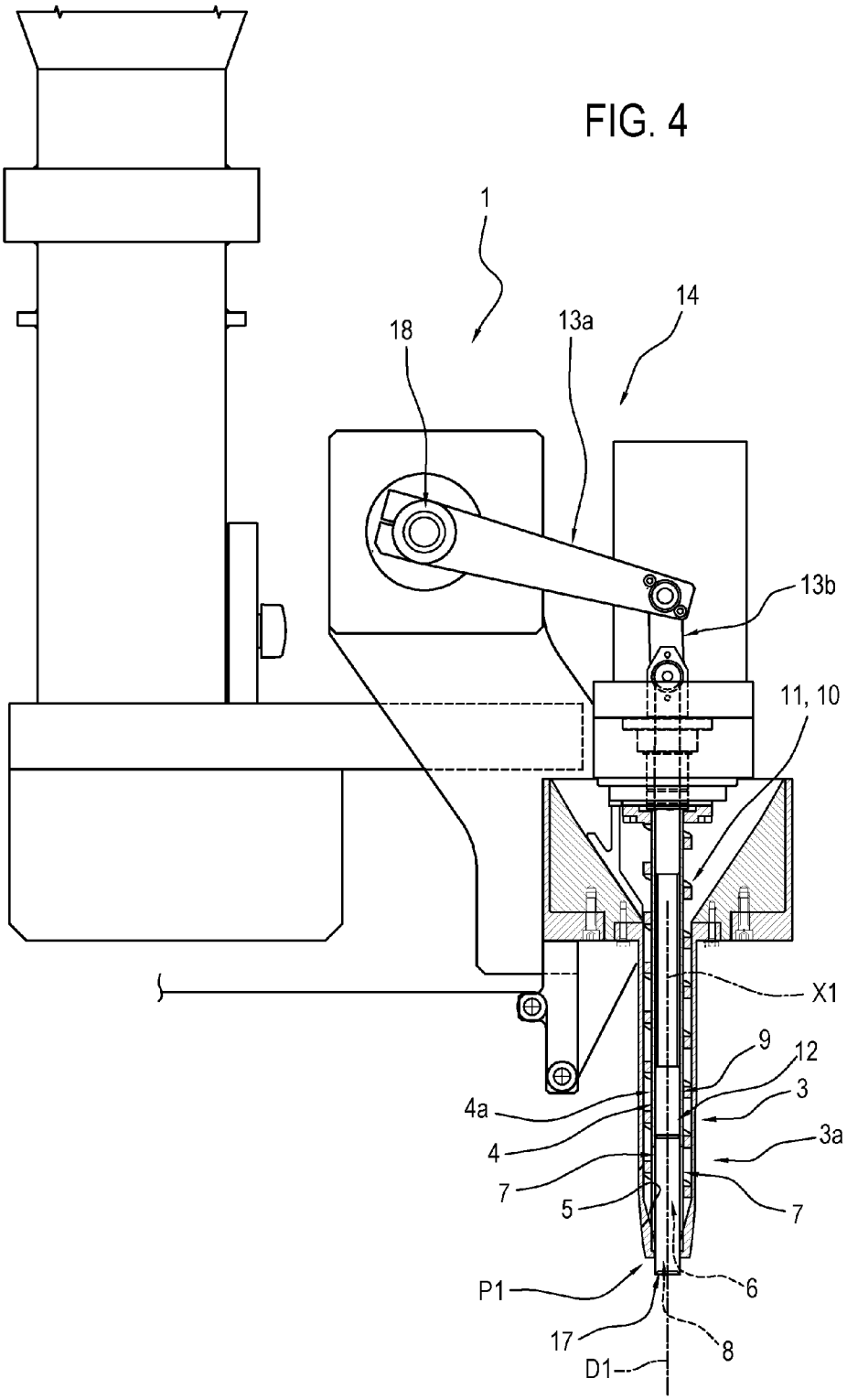

With reference to the accompanying drawings, the numeral 1 denotes a device for feeding and dosing infusion or extraction product and the numeral 100 denotes a machine for making filter bags S containing infusion or extraction product to which the feeding and dosing device 1 is applied.

It should be noted that the feeding device 1 and the machine 100 are particularly suitable for infusion products.

The feeding and dosing device 1 comprises, according to this invention, a space 2 for containing infusion or extraction product defined by an outer lateral wall 3 and an inner lateral wall 4 which has openings 7 for the passage of the product.

In the preferred embodiment illustrated, the outer lateral wall 3 comprises a bottom wall 5 which is in contact with the inner lateral wall 4. In an alternative embodiment not illustrated, the inner lateral wall 4 does not come into contact with bottom wall 5 leaving a passageway for the product; the passageway defining the openings 7.

It should be noted that the expression "wall" means a separating element. It should be noted that the expression "containment space" means a spatial region which contains (houses) product which must be fed and dosed in the filter bags S, as described and clarified below.

Preferably, the containment space 2 is shaped substantially in the form of a hollow cylinder.

Advantageously, the containment space 2 receives the product to be fed and dosed from a hopper, with which it is in flow communication. According to the invention, the device 1 also comprises a feeding chamber 6 made inside the inner lateral wall 4, communicating through the openings 7 with the containment space 2 and equipped with an outlet 8 leading outside the containment space 2 (below the containment space 2). More specifically, the outlet 8 releases the product onto an underlying continuous strip ST folded in a tubular shape which will constitute the filter bag S.

Preferably, the feeding chamber 6 is substantially cylindrical.

The device 1 also comprises a shutter 9 movable inside the feeding chamber 6 at least between a closed lower end position P1, wherein it occludes the openings 7, and an open upper end position P2, wherein it allows the free passage a dose of product from the containment space 2 to the feeding chamber 6 through the openings 7, towards the outlet 8 of the feeding chamber.

In other words, the shutter 9 in the upper end open position P2 allows the passage of the product from the containment space 2 to the feeding chamber 6 through the openings 7 and from the feeding chamber 6 to a filter bag S being formed through the outlet 8.

The shutter 9 allows the passage (at least partial) of the product from the containment space 2 to the feeding chamber 6 through the openings 7 and from the feeding chamber 6 to a filter bag S being formed through the outlet 8 when it does not occlude completely the openings 7, that is, in intermediate positions between the closed position P1 and the open position P2.

It is possible interrupt the passage of the product in the event of machine shutdown, maintenance, or other, positioning the shutter 9 in the closed position P1.

The shutter 9 is movable along a predetermined direction D1.

The shutter 9 comprises a piston 12, having a lateral wall 16 for closing the openings 7 and a lower, or head, wall 17 designed to define in the open position P2 an upper wall of the feeding chamber 6.

It should be noted that the head wall (lower) 17 is also designed to make contact with the product (at the top), accelerating it. In other words, the shutter 9 pushes the product downwards towards the filter bag S being formed.

Moreover, the lower head wall 17 is housed inside the feeding chamber 6 in the upper end open position P2.

Advantageously, at the closed lower end position P1, the shutter 9, in particular the piston 12, may protrude from below the feeding chamber 6.

In other words, the lower head wall 17 is positioned outside the feeding chamber 6.

The shutter 9 also comprises a control rod 19, fixed above the piston 12.

In a preferred embodiment, the piston 12 and the control rod 19 are made in a single piece.

According to another aspect, preferably, the outer lateral wall 3 is an axially-symmetrical wall (yet more preferably cylindrical shape).

It should be noted that according to yet another aspect, the outer lateral wall 3 is made in a first element 3*a* with a tubular shape (forming part of the device 1).

Figure 5:
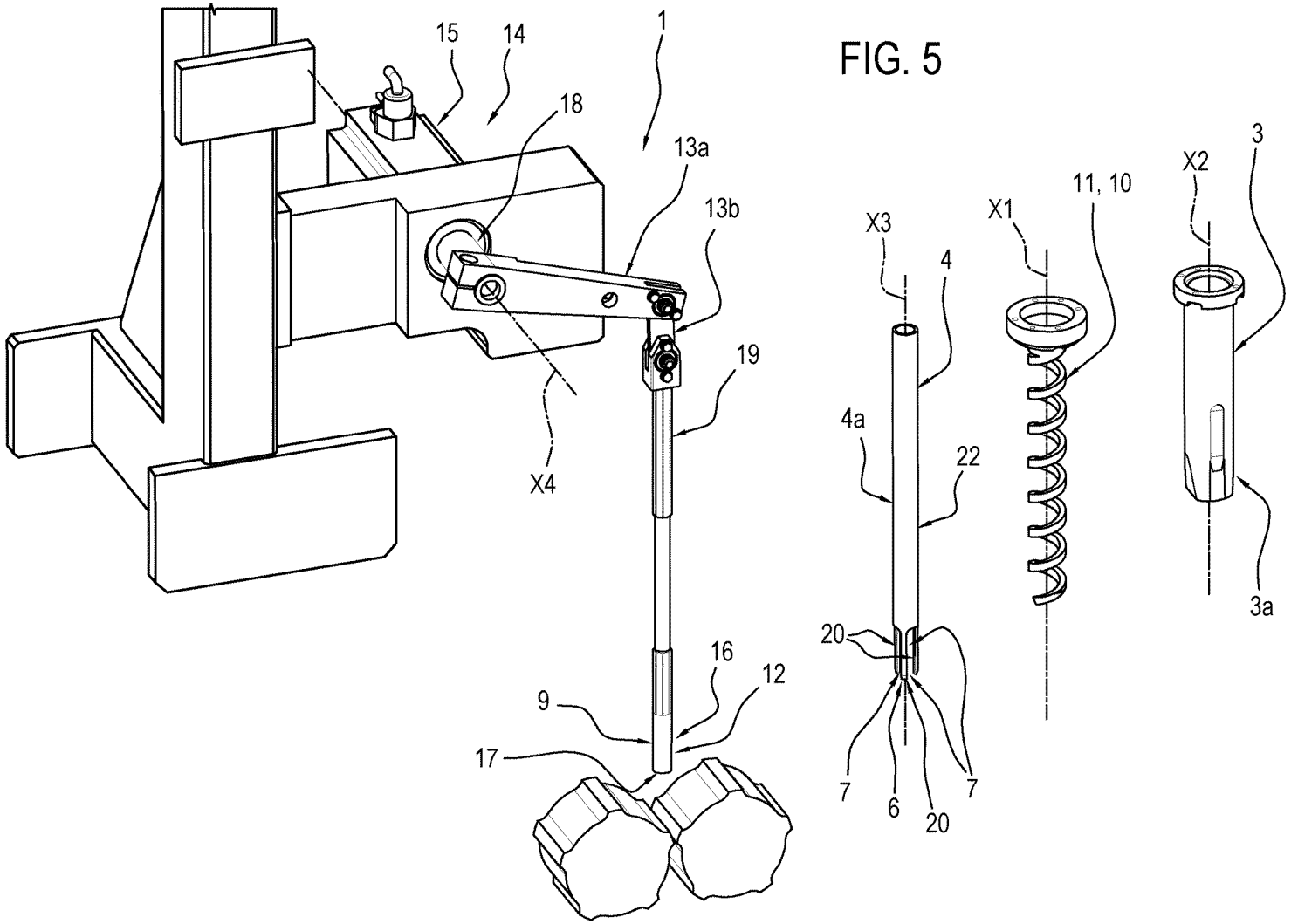
FIG. 5 is an exploded perspective view of the feeding and dosing device of FIG. 2.

The first element 3*a* with a tubular shape (shown clearly in FIG. 5) is fixed relative to the frame of the machine 100.

In other words, the device 1 comprises a first tubular element 3*a* having a lateral wall which defines the above-mentioned outer lateral wall 3.

According to yet another aspect, the inner lateral wall 4 is an axially-symmetrical wall (yet more preferably cylindrical in shape).

According to yet another aspect, the inner lateral wall 4 is made in a second tubular element 4*a*, located inside the first tubular element 3*a*.

The second tubular element 4*a* is fixed relative to the frame of the machine 100.

Preferably, the second tubular element 4*a* is positioned coaxially with the first tubular element 3*a*.

It should be noted that the first tubular element 3*a* extends along a relative longitudinal axis X2 of extension whilst the second tubular element 4*a* extends along a relative longitudinal axis X3 of extension.

It should be noted that, preferably, the longitudinal axis X2 of extension of the first tubular element 3*a* is parallel with the longitudinal axis X3 of extension of the second tubular element 4*a*.

More specifically, the longitudinal axis X2 of extension of the first tubular element 3*a* coincides with the longitudinal axis X3 of extension of the second tubular element 4*a*.

According to another aspect, the bottom wall 5 is made in the first tubular element 3*a*.

Therefore, according to this aspect, the bottom wall 5 is fixed to (integral with) the outer lateral wall 3.

It should be noted that, preferably, the bottom wall 5 is a wall having a truncated cone shape.

It should be noted, more specifically, that the shutter 9 is movably slidable inside the second tubular element 4*a* (between the above-mentioned closed position P1 and open position P2), by using the movement means 14.

More specifically, the shutter 9 is guided inside the second tubular element 4*a*, preferably, by a surface 21 inside the inner wall 4.

According to the embodiment illustrated, the movement means 14 comprise an actuator 15 (electric and/or pneumatic) having a shaft 18 configured to rotate about an axis X4 (horizontal).

Moreover, the movement means 14 comprise a first arm 13*a*, connected at a first end to the shaft 18 of the actuator 15 for rotating about the axis X4 as one with the shaft.

Again, the movement means 14 comprise a second arm 13*b*.

A second end of the first arm 13*a* is connected (rotatably) to a first end of the second arm 13*b*.

The second end of the second arm 13*b* is connected (rotatably) to the shutter 9, in particular to the control rod 19 of the shutter 9.

It should be noted that the first arm 13*a* and the second arm 13*b* define, together, an articulated arm.

In a preferred embodiment illustrated in the drawings, the device 1 also comprises a rotary member 11, positioned inside the containment space 2 and rotated to push the product to the openings 7.

This embodiment is particularly preferred for products which are not slidable; for products which are sufficiently slidable the rotary member 11 may be omitted. In other words, for slidable products, the products fall downwards, through the openings 7, by gravity, without further mechanical pushes.

It is clear that the rotary member can also be used for slidable products, to increase the speed of falling of the products themselves.

It should be noted that, preferably, the rotary member 11 pushes the product along a direction D3 for feeding the product to the filter bags S.

According to the embodiment illustrated, the rotary member 11 comprises a spiral-shaped element, or spiral 10, positioned between the outer lateral wall 3 and the inner lateral wall 4.

It should be noted that the spiral 10 has a substantially helical profile, extending around a relative longitudinal axis X1 of extension.

Preferably, the longitudinal axis X2 of extension of the first tubular element 3*a*, the longitudinal axis X3 of extension of the second tubular element 4*a* and the axis X1 of extension of the spiral 10 are parallel to each other (preferably coincident).

Moreover, preferably, the longitudinal axis X2 of extension of the first tubular element 3*a*, the longitudinal axis X3 of extension of the second tubular element 4*a* and the axis X1 of extension of the spiral 10 are parallel to the direction D1 of movement of the shutter 9.

It should be noted, with reference to spiral 10, that the axis X1 of extension of the spiral 10 is parallel to the direction D1 of movement of the shutter 9.

The rotary member 11 (spiral 10) is configured for rotating preferably relative to the outer lateral wall 3 of the containment space 2.

Again, preferably, the rotary member 11 is configured to rotate relative to the inner lateral wall 4 of the containment space 2.

Still more preferably, the rotary member 11 is configured to rotate relative to the outer and inner lateral walls 3, 4 of the containment space 2.

The spiral 10 may exert a scraper action on one (or on both) between an outer surface 22 of the inner lateral wall 4 (that is, on a surface 22 of the inner lateral wall 4 which faces the containment space 2) and an inner surface 23 of the outer lateral wall 3 (that is, on a surface 23 of the outer lateral wall 3 which faces the containment space 2). The spiral 10 is connected to an actuator, which makes it possible to rotate the spiral about the relative longitudinal axis X1 of exension.

Advantageously, the actuator may rotate the spiral 10 both in step mode and continuously.

When operating in a stepwise fashion, the quantity of product introduced into the feeding chamber 6, equal to a dose of product, is defined by an angle of rotation followed by the spiral 10 in a machine step.

Advantageously, the actuator which rotates the spiral 10 is synchronised with the means 14 for moving shutter 9, for rotating the spiral 10 when the shutter 9 does not occlude the openings 7. When the spiral 10 is stationary, the product not is fed, or, in other words, the spiral 10 acts as a block for the product contained in the containment space 2.

When operating the spiral 10 in continuous mode, the quantity of product introduced into the feeding chamber 6 depends on a speed of rotation of the spiral 10 and a opening time of the openings 7 (that is to say, a time in which the shutter 9 does not occlude the openings 7). The actuator is designed to vary the size of the angle of rotation and the speed of rotation of the spiral 10 so as to modify the quantity of product which, through the openings 7, is introduced into the feeding chamber 6 (under equal conditions of time of opening of the openings 7).

In effect, the greater is the angle of rotation (during operation in step mode) and the speed of rotation (in the continuous operation mode) of the spiral 10, the greater is the quantity of product fed that, that is, introduced into the feeding chamber 6 through the openings 7.

It is clear that the product, pushed by the spiral 10 (or, falling by gravity when the spiral 10 is omitted), passes through the openings 7 only when the latter are not completely occluded by the shutter 9, that is, when the shutter is not in the closed position P1. On the other hand, the openings 7 are partly open, and allow the passage of the product, when the shutter 9 adopts intermediate positions included between the closed position P1 and the open position P2, during both its forward stroke towards the open position P2, and during its return stroke towards the closed position P1. In short, the shutter 9 passing from the closed position P1 to the open position P2 (and vice versa) allows the passage of product, increasing (decreasing) the passageway of the openings 7. Also with the openings 7 open, if the spiral 10 is stationary, the product does not pass through the openings 7, because the spiral 10 acts as a block for the product.

During operation in step-mode, the actuation is advantageously designed to rotate the spiral 10 also when the openings 7 are at least partly open.

Alternatively, again during operation in step-mode, the actuation is designed to rotate the spiral 10 also when the openings 7 are completely closed by the shutter 9, thereby compacting the product.

In the continuous operation mode, the product is in any case compressed, since the spiral 10 is rotated also when the openings 7 are completely closed by the shutter 9.

Advantageously, the longitudinal axis X1 of extension of the spiral 10 is positioned in use vertically.

It should be noted that, preferably, the longitudinal axis X1 of extension of the spiral 10 substantially coincides with a longitudinal axis X2 of extension of the first tubular element 3*a* and with a longitudinal axis X3 of extension of the second tubular element 4*a*.

With reference to the openings 7, it should be noted that these openings 7 are defined, according to an embodiment which is not illustrated, by slits having a main extension along the direction D3 for feeding the product to the filter bags S.

Preferably, the openings 7 are made at an end of the inner wall 4 of the second tubular element 4*a*. Preferably, the openings 7 are made at a lower end of the inner wall 4 of the second tubular element 4*a*.

With reference to the embodiment illustrated, it should be noted that the openings 7 are defined by recesses made in the inner wall 4 of the second tubular element 4*a*.

More specifically, these recesses define prongs 20 on a longitudinal end (lower) of the second tubular element 4*a*. The prongs 20 are preferably positioned substantially in contact with the bottom wall 5.

The openings 7 are made on the second tubular element 4*a*.

The feeding and dosing of the product is described below, with the aim of clarifying the scope of the invention.

During normal use of the feeding and dosing device 1, the containment space 2 is filled with infusion or extraction product (such as, for example, tea, camomile, herbal tea, coffee, etc.).

A dosing cycle, starting from the closed position P1 of the shutter 9, wherein the introduction of product inside the feeding chamber 6 is substantially prevented, comprises the following operations.

The shutter 9 is moved (using the movement means 14) along the forward stroke from the closed position P1 to the open position P2, wherein the openings 7 are not (at least partly) occluded by the lateral wall 16 for closing the shutter 9, that is to say, they allow the free passage of product from the containment space 2 to the feeding chamber 6.

It should be noted, therefore, that the feeding chamber 6 is substantially occupied by the shutter 9 when the shutter is in the closed position P1, whilst when the shutter 9 during the return stroke moves towards, and reaches, the open position P2, the openings 7 are at least partly open and the chamber 6 is available to receive product.

For this reason, the shutter 9—in its forward stroke towards the open position P2 and in its return stroke towards the closed position P1—allows the passage (at least partly) of product from the containment space 2 to the feeding chamber 6 towards the outlet 8.

When operating without spiral 10 (that is, for slidable products which fall by gravity), or when operating with spiral 10 rotated continuously, the quantity of product fed depends on the time in which the shutter 9 leaves the openings 7 at least partly open.

In the case of spiral 10 moved in a stepwise fashion when the openings 7 are at least partly opened, the angle of rotation of the spiral 10 defines the quantity of product fed. In this way, a volumetric type dosing of the product is substantially performed.

With the shutter 9 positioned in such a way as to not occlude completely the openings 7, the containment space 2 is in communication with the feeding chamber 6 and therefore the feeding chamber 6 may be passed through by the product, which falls by gravity downwards, passing through the outlet 8.

Preferably, in order to favour the passage of product (in particular for non-slidable products) from the containment space 2 to the feeding chamber 6, the spiral 10 may be provided, rotated in step or continuous fashion.

In this way, advantageously, the spiral 10 applies a pushing action on the product present in the containment space 2, which favours the introduction into the feeding chamber 6 of the product through the openings 7.

The shutter 9 is then moved along the return stroke from the open position P2 to the closed position P1. During the return stroke, the shutter 9 pushes the product downwards in acceleration and reduces the passageway of the openings 7 until occluding them completely.

In this way, the shutter 9 pushes the product towards the outlet 8 (positioned below) of the feeding chamber 6, releasing the product in the underlying strip continuous ST of filter material which will define the next filter bag S.

In this way, a dose of product is released on the underlying continuous strip ST of filter material which will define the next filter bag S.

It should be noted that the feeding and dosing device 1 is particularly precise and accurate in terms of quantity of product released inside each filter bag S, and therefore allows the variability of the quantity of product inserted between one filter bag S and another to be reduced.

The invention also defines a machine 100 for making filter bags containing infusion or extraction product, comprising in combination:

- a station 101 for feeding a continuous strip ST of filter material;
- a station 102 for forming and joining the continuous strip ST into a closed tubular shape and feeding along a feed direction V1 (preferably, but not necessarily vertical);
- a station 103 for feeding and dosing the infusion or extraction product positioned above the forming and joining station 102 and comprising the feeding and dosing device 1 described above;
- a station 104 for joining an open end of the continuous strip S in the tubular shape, alternately forming, respectively, a top end of a filter bag S being formed and a bottom end of the next filter bag S, with the joining station 104 positioned downstream of the forming and joining station 102 relative to the feed direction V1 of the continuous strip ST;
- a station 105 for separating a filter bag S already formed from a next filter bag S being formed positioned downstream of the forming and joining station 102 relative to the feed direction V1 of the continuous strip ST.

It should be noted that, preferably, the direction D1 of movement of the shutter 9 is parallel with a feed direction D2 of the continuous strip ST. Further, preferably, the direction D1 of movement of the shutter 9, the feed direction D2 of the continuous strip ST and the direction D3 for feeding the product to the filter bags S are parallel to each other.

The feeding and dosing station 103 may advantageously comprise a hopper for feeding the product, connected in flow communication to the containment space 2 of the feeding device 1.

According to another aspect, a method is also defined for feeding and dosing infusion or extraction product inside a continuous strip (ST) defining filter bags (S), comprising the following steps:

- preparing a continuous strip ST of filter material and joining the continuous strip ST to define a closed tubular shape and feeding along a feed direction D2 (preferably vertical);
- preparing a feeding and dosing device 1 as described above;
- moving the shutter 9 from the closed position P1 to the open position P2, to allow a dose of product to pass from the containment space 2 to the feeding chamber 6 through the openings 7 and from the feeding chamber 6 to a filter bag S being formed through the outlet 8;
- moving the shutter 9 from the open position P2 to the closed position P1, to favour an escape of the dose of product present inside the feeding chamber 6 through the outlet 8 of the feeding chamber 6, releasing the dose of product inside the joined continuous strip ST, and occluding the openings 7.

Advantageously, the method comprises controlling the shutter 9 for varying an opening time of the openings 7 and adjusting a quantity of the product fed to the feeding chamber 6. More specifically, the method comprises controlling a forward stroke and/or a return stroke of the shutter 9 for varying the open time of the openings 7, that is, for each machine step, a time wherein the openings 7 are not completely occluded by the shutter 9.

According to another aspect, the method comprises a step of preparing a rotary member 11 inside the containment space 2 and a step of rotating the rotary member 11 for moving the product present inside the containment space 2 towards the openings 7. Advantageously, the rotary member 11 may be actuated continuously or in step mode.

Advantageously, according to the method, the rotation of the rotary member 11 is controlled, for adjusting the dose of product fed to the feeding chamber 6 through the openings 7.

More specifically, when operating in step mode, an angle of rotation of the rotary member 11 is controlled for adjusting the dose of product being fed. The greater the angle of rotation followed by the member 11 rotating in step mode, the greater the dose of product fed, and vice versa.

When operating continuously, a speed of rotation of the rotary member 11 is controlled for adjusting the dose of product being fed. The greater the speed of the rotary member 11, the greater the dose of the product fed, and vice versa.

The invention claimed is:

1. A device for feeding and dosing infusion or extraction product for a machine for making filter bags containing infusion or extraction product, wherein it comprises:

- a containment space for containing infusion or extraction product defined by an outer lateral wall and by an inner lateral wall which has openings for the passage of the product;
- a feeding chamber made inside the inner lateral wall, communicating through the openings with the containment space and equipped with an outlet leading outside the containment space;
- a shutter, movable along a predetermined direction of movement inside the feeding chamber between a lower end closing position, wherein it occludes the openings, and an upper end open position, wherein it allows the passage of a dose of product from the containment space to the feeding chamber through the openings and from the feeding chamber to a filter bag being formed through the outlet.

2. The device according to claim 1, wherein the outer lateral wall is a cylindrical wall.

3. The device according to claim 1, wherein the outer lateral wall is made in a first tubular element.

4. The device according to claim 1, wherein the inner lateral wall is a cylindrical wall.

5. The device according to claim 1, wherein the outer lateral wall is made in a first tubular element and wherein the inner lateral wall is made in a second tubular element, located inside the first tubular element.

6. The device according to claim 1, comprising a rotary member, positioned inside the containment space and rotated to push the product inside the containment space towards the openings.

7. The device according to claim 6, wherein the rotary member comprises a spiral, positioned between the outer lateral wall and the inner lateral wall.

8. The device according to claim 7, wherein the outer lateral wall is made in a first tubular element having a relative longitudinal axis of extension and wherein the inner lateral wall is made in a second tubular element, located inside the first tubular element and having a relative longitudinal axis of extension, and wherein the spiral extends along, and rotates relative to, a longitudinal axis of extension parallel to the longitudinal axes of extension, respectively, of the first tubular element and of the second tubular element.

9. The device according to claim 8, wherein the axes of longitudinal extension of the spiral, of the first tubular element and of the second tubular element are parallel to the direction of movement of the shutter.

10. The device according to claim 1, wherein the shutter comprises a piston, having a lateral wall for closing the opening and a lower wall designed to define an upper wall of the feeding chamber.

11. The device according to claim 1, wherein the openings are defined by recesses made in the inner lateral wall and having a main extension along a direction for feeding the product.

12. The device according to claim 11, wherein the openings are made at a lower end of the inner lateral wall.

13. A machine for making filter bags containing infusion or extraction product, wherein it comprises:

a station for feeding a continuous strip of filter material;

a station for forming and joining the continuous strip into a closed tubular shape and feeding along a feed direction;

a station for feeding and dosing the infusion or extraction product positioned above the forming and joining station and comprising the feeding and dosing device according to claim 1;

a station for joining an open end of the continuous strip in the tubular shape, alternately forming, respectively, a top end of a filter bag being formed and a bottom end of the next filter bag, with the joining station positioned downstream of the forming and joining station relative to the feed direction of the continuous strip;

a station for separating a filter bag already formed from a next filter bag being formed positioned downstream of the forming and joining station relative to the feed direction of the continuous strip.

14. A method for feeding and dosing infusion or extraction product inside a continuous strip of filter material defining filter bags, wherein it comprises the following steps:

preparing a continuous strip of filter material and joining the continuous strip to define a closed tubular shape and feeding along a vertical feed direction;

preparing a feeding and dosing device according to claim 1;

moving the shutter of the feeding and dosing device from the closed position to the open position, to allow a dose of product to pass from the containment space to the feeding chamber through the openings and from the feeding chamber to a filter bag being formed through the outlet;

moving the shutter from the open position to the closed position, to favour an escape of the dose of product present inside the feeding chamber through the outlet, releasing the dose of product inside the joined continuous strip, and occluding the openings.

15. The method according to claim 14, comprising a step of controlling the shutter for varying an opening time of the openings and adjusting a quantity of the product fed to the feeding chamber.

16. The method according to claim 14, comprising a step of preparing a rotary member inside the containment space of the feeding and dosing device and a step of rotating the rotary member for moving the product present inside the containment space towards the openings.

17. The method according to claim 16, comprising a step of controlling the rotation of the rotary member, for adjusting the dose of product fed to the feeding chamber through the openings.

18. The method according to claim 17, comprising a step of rotating the rotary member in step mode and a step of controlling an angle of rotation of the rotary member for adjusting the dose of product fed.

19. The method according claim 17, comprising a step of rotating the rotary member in continuous mode and a step of controlling a speed of rotation of the rotary member for adjusting the dose of product fed.

* * * * *